US010067475B2

(12) United States Patent
Niwa et al.

(10) Patent No.: US 10,067,475 B2
(45) Date of Patent: Sep. 4, 2018

(54) TIMEPIECE

(71) Applicant: SEIKO INSTRUMENTS INC., Chiba-shi, Chiba (JP)

(72) Inventors: Takashi Niwa, Chiba (JP); Takuma Kawauchiya, Chiba (JP); Masahiro Nakajima, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 15/407,072

(22) Filed: Jan. 16, 2017

(65) Prior Publication Data

US 2017/0212475 A1 Jul. 27, 2017

(30) Foreign Application Priority Data

Jan. 27, 2016 (JP) ..... 2016-013407
Nov. 29, 2016 (JP) ..... 2016/231283

(51) Int. Cl.
*G04B 21/06* (2006.01)
*G04B 21/08* (2006.01)
*G04B 37/08* (2006.01)

(52) U.S. Cl.
CPC ..... *G04B 37/081* (2013.01); *G04B 21/06* (2013.01); *G04B 21/08* (2013.01)

(58) Field of Classification Search
CPC ..... G04B 21/02; G04B 21/08; G04B 21/06; G04B 23/10; G04B 23/12; G04B 17/00; G04B 37/00; G04B 37/081
See application file for complete search history.

(56) References Cited

U.S. PATENT DOCUMENTS 1,522,217 A * 1/1925 Warren ..... G04B 17/30 188/187
1,907,282 A * 5/1933 Waldheim ..... G04B 23/10 368/245
2,786,326 A * 3/1957 Junghans ..... G04B 21/08 340/391.1
2,873,573 A * 2/1959 Simon ..... G04B 23/12 116/167
4,203,279 A * 5/1980 Kamiya ..... G04B 23/10 368/243
4,233,679 A * 11/1980 Schwarzschild ..... G04G 13/021 340/384.6
4,918,674 A * 4/1990 Shimozono ..... G04B 23/028 368/255
6,219,304 B1 * 4/2001 Mignot ..... G04B 37/0075 368/250

(Continued)

OTHER PUBLICATIONS

Abstract of WO2012151710 dated Nov. 15, 2012.

*Primary Examiner* — Vit W Miska
(74) *Attorney, Agent, or Firm* — Adams & Wilks

(57) ABSTRACT

A timepiece is equipped with a movement, a timepiece case accommodating the movement, and a hollow tubular structure portion having a connection proximal portion directly or indirectly in contact with the movement. The hollow tubular structure portion is formed such that a space defined between itself and the timepiece case is hermetically sealed. The inner space of the hollow tubular structure portion communicates with the exterior of the timepiece case via an external opening of the timepiece case. The timepiece can secure a sufficient waterproof performance and can transmit sound from a sound source efficiently to the exterior.

20 Claims, 12 Drawing Sheets

(56) References Cited

U.S. PATENT DOCUMENTS

| | | | | |
|---|---|---|---|---|
| 7,742,365 | B2 * | 6/2010 | Moteki | G04B 21/06 368/269 |
| 8,770,833 | B2 * | 7/2014 | Sciascia | G04B 37/0075 368/315 |
| 9,164,487 | B1 * | 10/2015 | Raggi | G04B 21/02 |
| 9,360,843 | B2 * | 6/2016 | Kadmiri | G04B 21/02 |
| 2008/0049561 | A1 | 2/2008 | Ozawa | 368/291 |
| 2011/0228647 | A1 * | 9/2011 | Karapatis | G04B 21/08 368/244 |

* cited by examiner

TIMEPIECE

BACKGROUND OF THE INVENTION

1. Field of the Invention

The present invention relates to a timepiece.

2. Description of Related Art

Conventionally, there has been used a timepiece having a sound generating mechanism such as an alarm or a minute repeater. In a timepiece of this type, it is required that loud sound should be issued in order to allow the user to reliably recognize the sound. On the other hand, in some cases, a waterproof performance is required of a timepiece.

The timepiece disclosed in JP-T-2014-513309 (Patent Document 1) is equipped with a case including a sealed portion and a non-sealed portion, an hour striking mechanism arranged in the sealed portion, and a bell operated by the hour striking mechanism. The entire bell is provided inside the non-sealed portion of the case.

The timepiece disclosed in JP-A-2008-76380 (Patent Document 2) is equipped with an exterior case, a sound source arranged inside the exterior case, and an inner filter that is breathable and waterproof.

In the construction disclosed in Patent Document 1, however, the bell, which is the sound generation source, is situated in the non-sealed portion, and the mechanism generating sound is within the sealed portion. Thus, in order to ring the bell, it is necessary to provide a mechanism operating astride the sealed portion and the non-sealed portion, sometimes resulting in a problem in terms of waterproof performance at the border between the sealed portion and the non-sealed portion.

The construction disclosed in Patent Document 2 has the inner filter, so that the sound emitted from the sound source is not easily transmitted to the exterior of the case.

SUMMARY OF THE INVENTION

It is an aspect of the present application to provide a timepiece which can secure a sufficient waterproof performance and which can efficiently transmit sound from a sound source to the exterior.

(1) According to the present application, there is provided a timepiece including: a movement; a case accommodating the movement; and a hollow structure portion having an oscillating portion directly or indirectly in contact with the movement, wherein the hollow structure portion is formed such that a space defined between itself and the case is of a hermetic structure; and the inner space of the hollow structure portion communicates with the external space of the case via an external opening of the case.

In this construction, sound generated through oscillation of the movement is transmitted to the external space via the inner space of the hollow structure portion and through the external opening. Thus, it is possible to transmit sound generated at the movement (e.g., ticking sound) to the exterior efficiently and at a high volume level. Further, the hollow structure portion is formed such that the space defined between itself and the case is a hermetic structure, so that it is possible to secure a waterproof performance.

(2) The oscillating portion may constitute apart of the hollow structure portion and face the inner space.

In this construction, the oscillation of the movement can be efficiently transmitted to the inner space of the hollow structure portion. Further, it is possible to simplify the structure of the case interior, and to achieve a reduction in size and cost.

(3) The oscillating portion may be in contact with a main plate of the movement directly or indirectly.

In this construction, the oscillation generated in the movement can be efficiently transmitted to the hollow structure portion. Thus, it is possible to transmit the sound generated in the movement to the exterior efficiently and at a high volume level.

(4) The timepiece may further include a gong connected to the oscillating portion, wherein the movement has a hammer striking the gong.

In this construction, due to the provision of the gong, it is possible to transmit loud sound to the exterior.

(5) The movement may have a hammer striking the hollow structure portion.

In this construction, it is possible to directly strike the hollow structure portion by the hammer, causing the hollow structure portion to oscillate greatly, so that it is possible to increase the volume of the sound emitted through the external opening. Further, since there is no need to provide a gong, it is possible to achieve space saving in the space inside the case. Thus, it is possible to achieve a reduction in the size of the timepiece.

(6) The hollow structure portion may not protrude with respect to the external surface of the case.

In this construction, it is possible to achieve a reduction in size, and to provide a timepiece superior in terms of design.

(7) The hollow structure portion may extend in a predetermined direction, and the inner space may communicate with the external space respectively through external openings of the case at both end portions of the hollow structure portion.

In this construction, the sound generated in the movement can be efficiently transmitted to the exterior through the two external openings.

(8) The inner diameter of the external opening may be larger than the inner diameter of the hollow structure portion at the oscillating portion.

In this construction, it is possible to diminish the influence of the diffraction of the sound, etc., making it possible to increase the volume of the sound emitted through the external opening. Thus, the sound generated in the movement (e.g., the ticking sound) can be transmitted to the exterior at a higher volume level.

(9) In the timepiece, an abutment protrusion may be formed on at least one of the movement and the oscillating portion; and the movement and the oscillating portion abut each other at the abutment protrusion, whereby the movement is held in contact with solely a part of the oscillating portion.

In this construction, the oscillating portion oscillates easily, so that the sound generated in the movement (e.g., the ticking sound) can be transmitted to the exterior at a higher volume level via the hollow structure portion.

(10) The abutment protrusion may be formed as a curved protrusion.

In this construction, the abutment protrusion comes into point contact with the oscillating portion, so that the contact area between the abutment protrusion and the oscillating portion is small; thus, it is easier for the oscillating portion to oscillate. Thus, it is possible to transmit the sound generated in the movement (e.g., the ticking sound) to the exterior at a high volume level via the hollow structure portion.

(11) In the timepiece, at least a part of the oscillating portion may be formed as a thin-walled portion which is more thin-walled than the other portion of the hollow structure portion, and the thin-walled portion may be in contact with the movement.

In this construction, it is easier for the oscillating portion to oscillate, so that it is possible to transmit the sound generated in the movement (e.g., the ticking sound) to the exterior at a higher volume level.

(12) The movement may abut the case via an elastic support portion having elasticity.

In this construction, it is possible to transmit the oscillation of the movement preferentially to the oscillating portion, and it is possible to transmit the sound of the movement to the exterior at a higher volume level.

(13) The hollow structure portion is of a closed-pipe structure having the external opening solely at one end portion thereof, and the length as measured from the oscillating portion to the external opening can be expressed by formula (1).

$$\lambda_n(2n-1)/4 \quad (1)$$

(where $\lambda_n$ is the wavelength of the sound emitted from the movement; and n is a natural number.)

In this construction, it is possible to cause resonance in the hollow structure portion, so that it is possible to transmit the sound of the movement to the exterior at a higher volume level.

(14) The hollow structure portion is of an open-pipe structure having the external openings at both end portions thereof, the length thereof being expressed by formula (2).

$$\lambda_n \cdot n/4 \quad (2)$$

(where $\lambda_n$ is the wavelength of the sound emitted from the movement; and n is a natural number.)

In this construction, it is possible to cause resonance in the hollow structure portion, so that it is possible to transmit the sound of the movement to the exterior at a higher volume level.

(15) The movement may have a remontoir mechanism.

In this construction, it is possible to transmit the sound generated by the oscillation of the remontoir mechanism efficiently to the exterior by the hollow mechanism portion.

According to the present application, the sound generated by the oscillation of the movement is transmitted to the external space via the inner space of the hollow structure portion and through the external opening. Thus, the sound generated in the movement (e.g., the ticking sound) can be efficiently transmitted to the exterior at a high volume level.

According to the present application, the hollow structure portion is formed such that the space defined between itself and the case is of a hermetic structure, so that it is possible to secure a waterproof performance.

DESCRIPTION OF EMBODIMENTS

Embodiments of the present invention will be described with reference to the drawings.

[First Embodiment]

(Timepiece)

A mechanical body including the drive portion of a timepiece is generally referred to as a "movement." A complete product obtained by mounting a dial and indicator hands on the movement, and putting the whole into a timepiece case is referred to as the "complete" of the timepiece.

Figure 1:
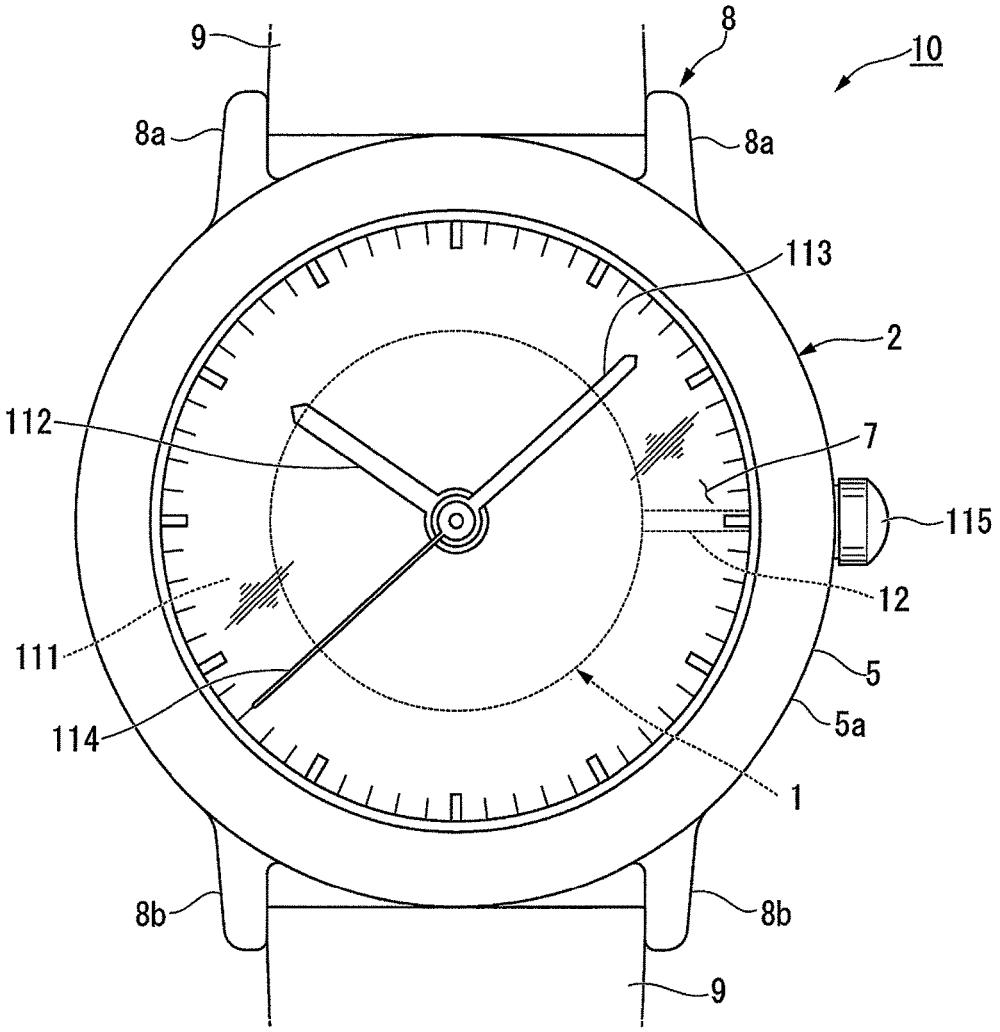
FIG. 1 is an external view of a timepiece according to a first embodiment of the present invention.
Figure 2:
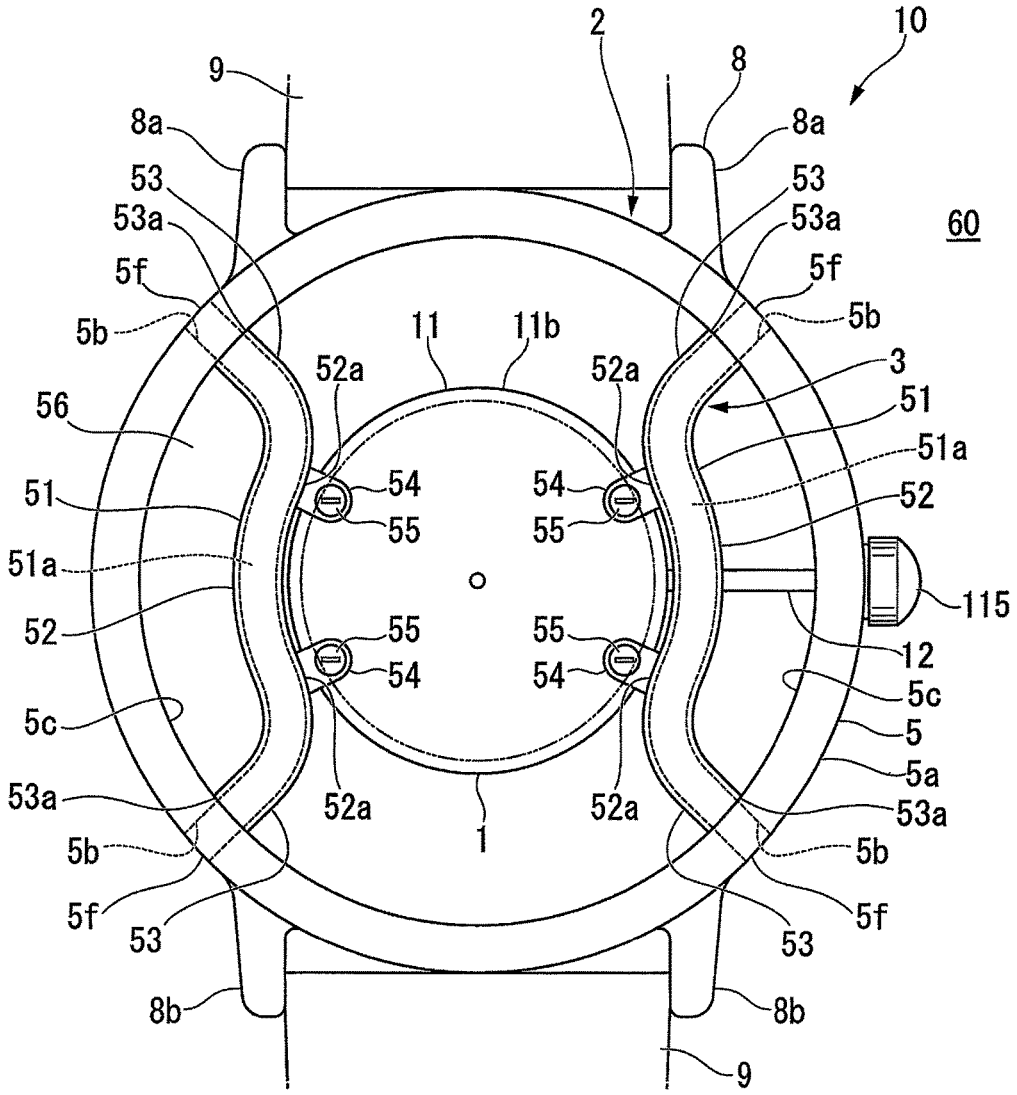
FIG. 2 is a plan view of the inner structure of the timepiece shown in FIG. 1.
Figure 3:
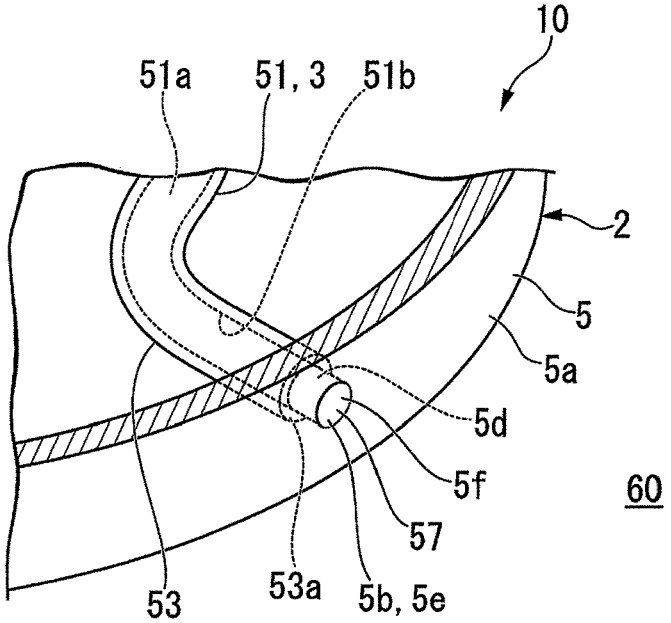
FIG. 3 is a perspective view of a part of the timepiece shown in FIG. 1.
Figure 4:
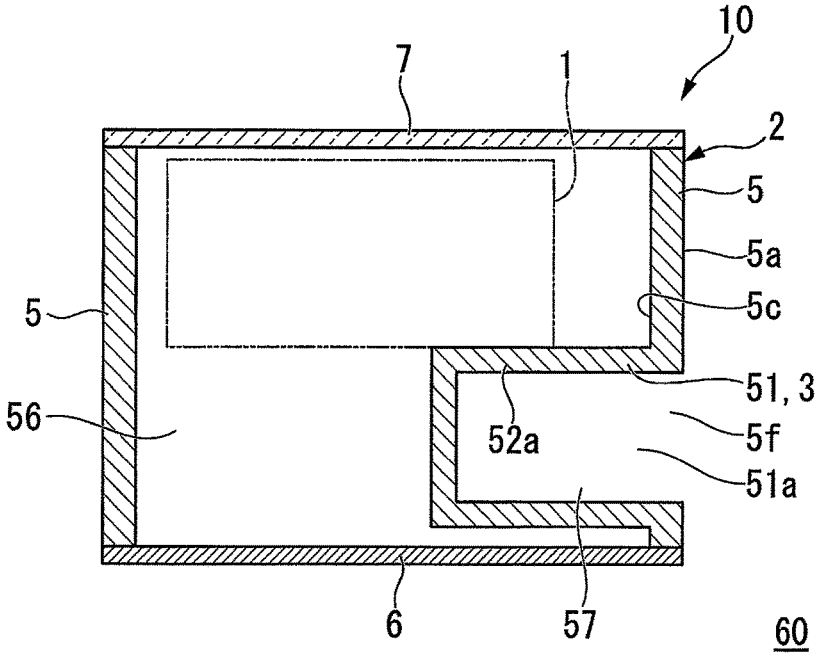
FIG. 4 is a diagram schematically illustrating the structure of the timepiece shown in FIG. 1.
Figure 5:
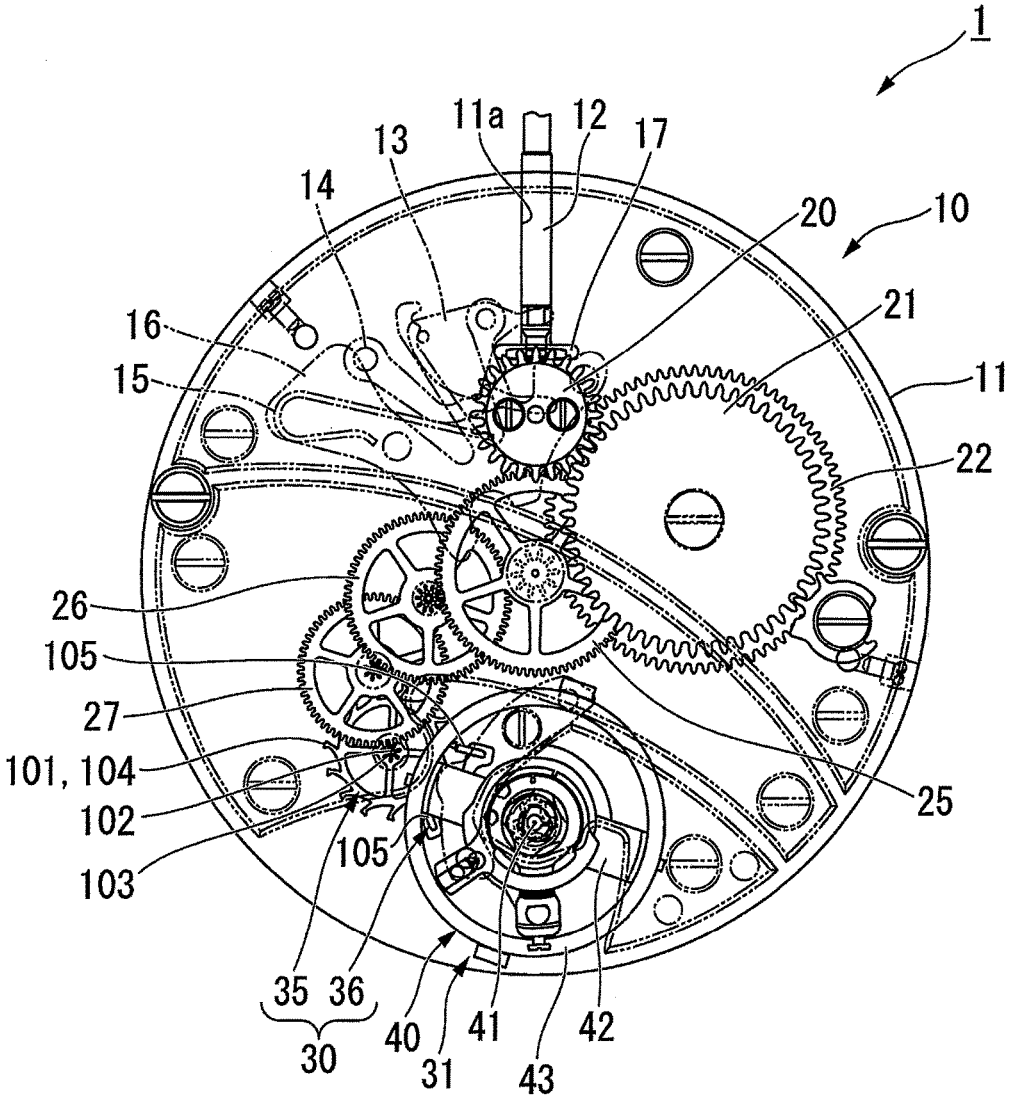
FIG. 5 is a plan view of a movement of the timepiece shown in FIG. 1.

FIG. 1 is an external view of a timepiece 10 according to the first embodiment. FIG. 2 is a plan view of the inner structure of the timepiece 10. FIG. 3 is a perspective view showing a part of the timepiece 10. FIG. 4 is a diagram schematically illustrating the structure of the timepiece 10. FIG. 5 is a plan view of a movement 1 of the timepiece 10.

As shown in FIGS. 1 and 4, the complete of the timepiece 10 is equipped with the movement 1, a timepiece case 2, and a sound emission structure portion 3.

The timepiece case 2 is equipped with a peripheral wall portion 5 which is, for example, of a cylindrical configuration, a case back portion 6 closing an opening on one side of the peripheral wall portion 5, a cover portion 7 closing an opening on the other side of the peripheral wall portion 5, and lugs 8 provided on an outer surface 5*a* of the peripheral wall portion 5.

As shown in FIG. 1, the lugs 8 include a pair of first lugs 8*a* and a pair of second lugs 8*b*. The first lugs 8*a* and the second lugs 8*b* are situated in rotational symmetry with respect to the center axis of the peripheral wall portion 5.

The first lugs 8*a* and the second lugs 8*b* are formed so as to protrude from the outer surface 5*a* of the peripheral wall portion 5. The pair of first lugs 8*a* are formed on the peripheral wall portion 5 at peripheral intervals, and can receive in the space between them an end portion of a timepiece belt 9. The pair of second lugs 8*b* are formed on the peripheral wall portion 5 at peripheral intervals, and can receive in the space between them an end portion of the timepiece belt 9.

The cover portion 7 is formed of a transparent material such as glass.

As shown in FIGS. 2 and 3, the peripheral wall portion 5 has, at four positions at intervals in the peripheral direction, through-holes 5*b* extending between the outer surface 5*a* and an inner surface 5*c* of the peripheral wall portion 5.

As shown in FIG. 1, the timepiece case 2 accommodates the movement 1, a dial 111 connected to the movement 1, and indicator hands 112 through 114. The dial 111 has at least a scale or the like indicating information on time. The indicator hands 112 through 114 include an hour hand 112 indicating hour, a minute hand 113 indicating minute, and a second hand 114 indicating second.

(Movement)

As shown in FIGS. 1 and 2, the movement 1 is arranged at the center of the timepiece case 2 in plan view.

FIG. 5 is a plan view of the front side of the movement 1.

As shown in FIG. 5, the movement 1 has a main plate 11 constituting the base plate. On the back side of the main plate 11, there is provided the dial 111 (See FIG. 1). The train wheel incorporated into the front side of the movement 1 is referred to as the front train wheel, and the train wheel incorporated into the back side of the movement 1 is referred to as the back train wheel.

A winding stem guide hole 11*a* is formed in the main plate 11, and a winding stem 12 is rotatably incorporated into the winding stem guide hole 11*a*. A crown 115 (See FIG. 1) is mounted to the distal end of the winding stem 12.

The position in the axial direction of the winding stem 12 is determined by a switching device having a setting lever 13, a yoke 14, a yoke spring 15, and a setting lever jumper 16. A winding pinion 17 is rotatably provided on the guide shaft portion of the winding stem 12.

When the winding stem 12 is rotated in the state in which the winding stem 12 is situated at a first winding stem position ($0^{th}$ step) nearest to the inner side of the movement 1 along the rotational shaft, the winding pinion 17 is rotated via the rotation of a clutch wheel (not shown). Through the rotation of the winding pinion 17, a crown wheel 20 in mesh therewith rotates. Through the rotation of the crown wheel 20, a ratchet wheel 21 in mesh therewith rotates. Through the rotation of the ratchet wheel 21, a mainspring (power source) (not shown) accommodated in a movement barrel 22 is wound up.

Apart from the movement barrel (rotary component) 22 mentioned above, the front train wheel of the movement 1 is formed by a center wheel & pinion (rotary component) 25, a third wheel & pinion (rotary component) 26, and a second wheel & pinion (rotary component) 27, and serves to transmit the rotational force of the movement barrel 22. Further, on the front side of the movement 1, there are arranged an escapement mechanism 30 for controlling the rotation of the front train wheel, and a governor mechanism 31.

The center wheel & pinion 25 is a cogwheel in mesh with the movement barrel 22. The third wheel & pinion 26 is a cogwheel in mesh with the center wheel & pinion 25. The second wheel & pinion 27 is a cogwheel in mesh with the third wheel & pinion 26.

The escapement mechanism 30 is a mechanism that controls the rotation of the above-mentioned front train wheel, and is equipped with an escape wheel & pinion (rotary component) 35 in mesh with the second wheel & pinion 27, and a pallet fork (rotary component) 36 causing the escape wheel & pinion 35 to escape and rotate regularly.

The governor mechanism 31 is a mechanism governing the speed of the above-mentioned escapement mechanism 30, and is equipped with a balance with hairspring (rotary component) 40.

The escape wheel & pinion 35 of the escapement mechanism 30 is equipped with an escape wheel portion (rotary member) 101 and a shaft member (rotation shaft) 102 fixed coaxially to the escape wheel portion 101.

The shaft member 102 has an escape pinion portion 103 in mesh with the wheel portion of the second wheel & pinion 27. One end portion of the shaft member 102 is rotatably supported by a train wheel bridge (not shown), and the other end portion thereof is rotatably supported by the main plate 11.

The escape pinion portion 103 is brought into mesh with the second wheel & pinion 27, whereby the rotational force of the second wheel & pinion 27 is transmitted to the shaft member 102, and the escape wheel & pinion 35 rotates.

A plurality of tooth portions 104 of the escape wheel & pinion 35 are in mesh with the pallet fork 36. The pallet fork 36 is equipped with a body of pallet fork (not shown) having three pallet beams (not shown), and a pallet staff (not shown). In the pallet fork 36, the body of pallet fork is rotatable around the pallet staff.

At the distal ends of two pallet beams of the three pallet beams, there are provided pallets 105, and a pallet box (not shown) is mounted to the distal end of the remaining pallet beam.

The pallet beam to which the pallet box is mounted can come into contact with a banking pin (not shown) supported by the main plate 11.

The balance with hairspring 40 is equipped with a balance staff (rotation shaft) 41, a balance wheel (rotary body) 43 mounted to the balance staff 41 via an arm portion 42, and a hairspring (not shown). The power transmitted from the hairspring causes the balance with hairspring 40 to make normal and reverse rotation around the balance staff 41 at a fixed oscillation cycle.

One end portion of the rotation shaft of each of the escape wheel & pinion 35, the pallet fork 36, and the balance with hairspring 40 is rotatably supported by the main plate 11, and the other end portion thereof is rotatably supported by a bridge (not shown), whereby they are rotatably supported with respect to the main plate 11 and the bridge. The bridge is a member facing the main plate 11 at an interval.

As shown in FIGS. 2 and 3, the sound emission structure portion 3 has, for example, a pair of tubular structure portions 51 (hollow structure portions). As the tubular structure portions 51, it is possible to use tubular bodies formed of metal such as aluminum or stainless steel. The material of the tubular structure portions 51 is not restricted to metal; they may also be formed of some other material such as resin.

The pair of tubular structure portions 51 are in rotational symmetry with respect to, for example, the center axis of the peripheral wall portion 5. The tubular structure portions 51 are provided inside the timepiece case 2.

The inner diameter and the outer diameter, for example, of the tubular structure portions 51 may be fixed in the length direction. As described below, when the inner diameter of the tubular structure portions 51 is fixed in the length direction, it is easier to cause resonance.

Each tubular structure portion 51 has a central portion 52, extension portions 53 extending toward the peripheral wall portion 5 from both ends of the central portion 52, and a pair of connection portions 54 formed on the outer surface of the central portion 52.

In plan view, the central portion 52 is formed, for example, in an arcuate configuration extending along the outer edge 11*b* of the main plate 11 of the movement 1. In plan view, the central portion 52 is situated, for example, on the outer side in the radial direction of the outer edge 11*b* of the main plate 11.

Each connection portion 54 is formed, for example, as a plate parallel to the main plate 11, and is formed so as to protrude to the inner side in the radial direction of the peripheral wall portion 5 from the outer surface of a connection proximal portion 52*a* (oscillation portion) which is a part of the central portion 52. The connection portions 54 are formed at intervals in the length direction of the central portion 52. The connection portions 54 are fixed to one surface of the main plate 11 by fastening members 55 through screwing or the like.

The inner surfaces of the connection proximal portions 52*a* face the inner space 51*a* of the tubular structure portion 51.

The distal end portions 53*a* of the extension portions 53 are bonded to the inner surface 5*c* of the peripheral wall portion 5 in a liquid-tight fashion. Thus, the space 56 defined between the tubular structure portion 51 and the timepiece case 2 (See FIG. 2) is hermetically sealed and constitutes a hermetic structure. Examples of the method of bonding the distal end portions 53*a* of the extension portions 53 to the peripheral wall portion 5 include welding, brazing, and thermal diffusion bonding.

The tubular structure portion 51 and the peripheral wall portion 5 may be formed as separate members, or they may be formed integrally. When the tubular structure portion 51 and the peripheral wall portion 5 are separate members, the tubular structure portion 51 and the peripheral wall portion 5 can be bonded to each other through the intermediation of no other component. When the tubular structure portion 51 and the peripheral wall portion 5 are formed integrally, the tubular structure portion 51 and the peripheral wall portion 5 can be prepared through machining, deep drawing, molding by a 3D printer, etc.

The distal end portion 53*a* of the extension portion 53 is connected to the peripheral wall portion 5 such that the inner space 51*a* of the tubular structure portion 51 and the inner space 5*d* of the through-hole 5*b* (See FIG. 3) communicate with each other. In FIGS. 2 and 3, the inner space 51*a* of the distal end portion 53*a* and the through-hole 5*b* have the same inner diameter, and they substantially coincide with each other in the forming positions at the inner surface 5*c* of the peripheral wall portion 5. Thus, the inner peripheral surface 51*b* of the tubular structure portion 51 and the inner peripheral surface 5*e* of the through-hole 5*b* form a smoothly continuous sound emission path 57.

An external opening 5*f* on the outer surface 5*a* side of the through-hole 5*b* is open to the external space 60 of the timepiece case 2.

The sound emission structure portion 3 (the tubular structure portion 51) and the movement 1 are fixed to each other via the connection portions 54, so that, schematically, the timepiece 10 is of a structure as shown in FIG. 4.

As shown in FIG. 4, the tubular structure portion 51 has a connection proximal portion 52*a* connected to the movement 1. The inner space 51*a* of the tubular structure portion 51 communicates with the external space 60 via the external opening 5*f* of the timepiece case 2.

While in FIG. 2 the connection proximal portion 52*a* of the tubular structure portion 51 is connected indirectly to the movement 1 via the connection portion 54, the connection proximal portion (oscillation portion) 52*a* may be directly connected to the movement 1. For example, a structure is possible in which the connection proximal portion 52*a* of the tubular structure portion 51 is in contact with the main plate 11.

The tubular structure portion 51 may be prepared by extrusion, drawing, roll molding, deep drawing or the like; or it may be prepared by sintering a molding formed by a 3D printer by using metal powder. When using resin, it is possible to adopt injection molding or the like. The tubular structure portion 51 may be prepared through machining.

Next, the operation of the timepiece 10 will be described.

As shown in FIG. 5, when the pallet fork 36 rotates around the pallet staff, the pallet 105 comes into contact with the distal end of a tooth portion 104 of the escape wheel & pinion 35. At this time, the pallet beam to which the pallet box is mounted comes into contact with the banking pin (not shown).

In the pallet fork 36, oscillation is generated when the pallet 105 comes into contact with the tooth portion 104 of the escape wheel & pinion 35, and when the pallet beam comes into contact with the banking pin.

The balance with hairspring 40 makes normal and reverse rotation at a fixed cycle by the power transmitted from the hairspring, so that it generates oscillation when the rotational direction changes.

As shown in FIGS. 2, 3, and 5, the oscillation generated in the pallet fork 36, the escape wheel & pinion 35, the banking pin, and the balance with hairspring 40 is transmitted to the main plate 11 and the bridge. The oscillation transmitted to the main plate 11 is transmitted to the connection proximal portion 52*a* of the tubular structure portion 51 via the connection portion 54.

The sound generated through the oscillation of the tubular structure portion 51 (e.g., the ticking sound) is transmitted to the external space 60 via the inner space 51*a* of the tubular structure portion 51 and through the external opening 5*f*.

In this way, the timepiece 10 has the tubular structure portion 51 having the connection proximal portion 52*a*, and the inner space 51*a* of the tubular structure portion 51 communicates with the external space 60 via the external opening 5*f*, so that the sound generated through the oscillation of the movement 1 is transmitted to the external space 60 via the inner space 51*a* of the tubular structure portion 51 and through the external opening 5*f*.

Thus, in the timepiece 10, it is possible to convert the oscillation to sound at a place (the connection proximal portion 52*a*) near the oscillation source of the oscillation generated in the movement 1 (e.g., the oscillation generated by the pallet fork 36), so that it is possible to transmit sound efficiently to the exterior. This sound is emitted to the exterior while increased in volume level due to resonance in the inner space 51*a* of the tubular structure portion 51, so that it is possible to transmit the sound generated in the movement 1 to the exterior at a high volume level.

In the timepiece 10, the space 56 defined between the tubular structure portion 51 and the timepiece case 2 is of a hermetic structure, so that even if some water enters the tubular structure portion 51, it is possible to prevent intrusion of water into the movement 1, etc. Thus, it is possible to secure a sufficient waterproof performance.

Further, in the timepiece 10, the oscillating (oscillation) portion (the connection proximal portion 52*a*) is in the tubular structure portion 51, so that, as compared with the case where the oscillating portion is in the timepiece case 2 (e.g., in the case where the thin-walled portion is in the peripheral wall portion 5), it is more difficult for an external force to act on the oscillating portion. Thus, the timepiece 10 is superior in terms of strength.

In the timepiece 10, the oscillation of the movement 1 is transmitted to the connection proximal portion 52*a* which is a part of the tubular structure portion 51 and which faces the inner space 51*a*, so that it is possible to efficiently transmit the oscillation of the movement 1 to the inner space 51*a* of the tubular structure portion 51. Further, the structure of the timepiece 10 can be simplified, making it possible to achieve a reduction in size and cost.

In the timepiece 10, the tubular structure portion 51 is connected to the main plate 11 supporting the pallet fork 36, etc., so that the oscillation generated in the pallet fork 36, etc. can be efficiently transmitted to the tubular structure portion 51. Thus, the sound generated in the movement 1 can be transmitted to the exterior at a high volume level.

In the timepiece 10, the distal end portion 53*a* of the tubular structure portion 51 is bonded to the inner surface 5*c* of the peripheral wall portion 5, so that the tubular structure portion 51 does not protrude from the outer surface of the timepiece case 2. That is, the tubular structure portion 51 is of a non-protrusion structure with respect to the outer surface of the timepiece case 2. Thus, the timepiece 10 can be reduced in size, and is superior in terms of design.

In the timepiece 10, the inner space 51*a* of the tubular structure portion 51 communicates with the external space 60 at both end portions of the tubular structure portion 51 respectively via the external openings 5*f*, so that it is possible to efficiently transmit the sound generated in the movement 1 to the exterior through the two external openings 5*f*.

[Second Embodiment]

Figure 6:
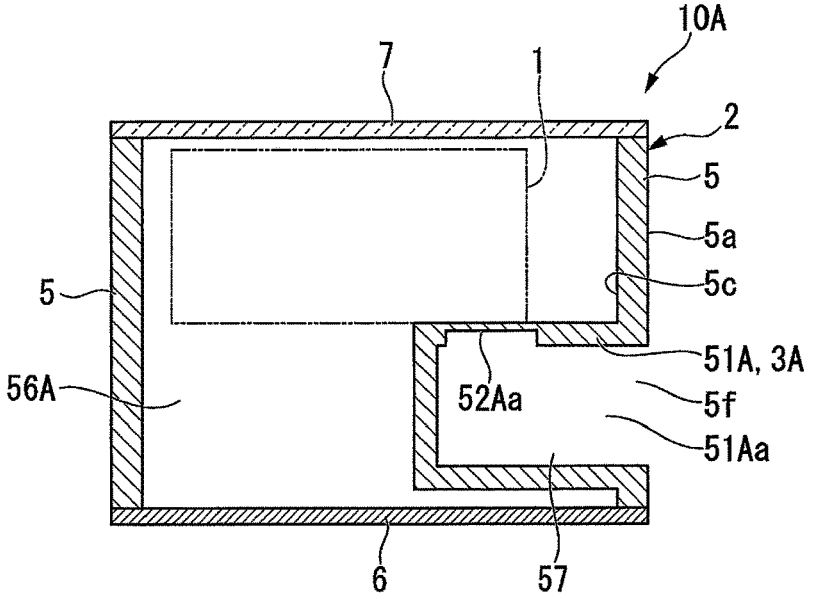
FIG. 6 is a diagram schematically illustrating the structure of a timepiece according to a second embodiment of the present invention.

FIG. 6 is a diagram schematically illustrating the structure of a timepiece 10A according to the second embodiment.

The timepiece 10A is equipped with the movement 1, the timepiece case 2, and a sound emission structure portion 3A having a tubular structure portion 51A (hollow structure portion). A connection proximal portion 52Aa (oscillating portion) which is a part of the tubular structure portion 51A (hollow structure portion) is more thin-walled as compared with the other portion of the tubular structure portion 51A. The inner surface of the connection proximal portion 52Aa faces an inner space 51Aa of the tubular structure portion 51A. The connection proximal portion 52Aa is connected to the movement 1 directly or indirectly. The connection proximal portion 52Aa is also referred to as the thin-walled portion.

A space 56A defined between the tubular structure portion 51A and the timepiece case 2 is of a hermetic structure.

Since it is thin-walled, the connection proximal portion 52Aa is subject to oscillation, so that the oscillation of the movement 1 is easily transmitted to the inner space 51Aa of the tubular structure portion 51A. Thus, the sound generated in the movement 1 (e.g., the ticking sound) can be transmitted to the exterior efficiently and at a high volume level via the inner space 51Aa of the tubular structure portion 51A.

Since it is thin-walled, the connection proximal portion 52Aa is of low mechanical strength; the tubular structure portion 51A, however, is formed inside the timepiece case 2, so that an external force does not easily act on the connection proximal portion 52Aa. Thus, there is no fear of a reduction in durability.

While in the timepiece 10A the entire connection proximal portion 52Aa is thin-walled, only a part of the connection proximal portion may be thin-walled.

[Third Embodiment]

Figure 7:
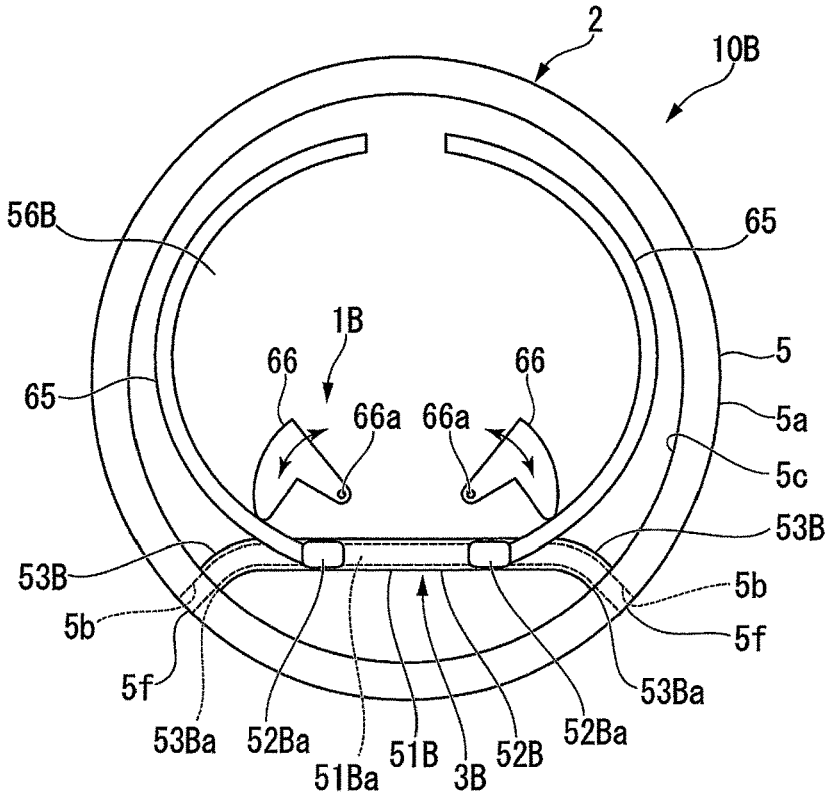
FIG. 7 is a diagram schematically illustrating the structure of a timepiece according to a third embodiment of the present invention.

FIG. 7 is a diagram schematically illustrating the structure of a timepiece 10B according to the third embodiment.

The timepiece 10B is equipped with a movement 1B, the timepiece case 2, and a sound emission structure portion 3B.

In addition to the construction similar to that of the movement 1 shown in FIG. 5, the movement 1B has a pair of hammers 66.

The sound emission structure portion 3B is equipped with a tubular structure portion 51B (hollow structure portion), and a pair of gongs 65 connected to the tubular structure portion 51B, and is provided inside the timepiece case 2.

The tubular structure portion 51B has a central portion 52B, and extension portions 53B extending from both ends of the central portion 52B toward the peripheral wall portion 5.

Distal end portions 53Ba of the extension portions 53B are bonded to the inner surface 5*c* of the peripheral wall portion 5 in a liquid-tight fashion, so that a space 56B defined between the tubular structure portion 51B and the timepiece case 2 is of a hermetic structure.

The distal end portions 53Ba of the extension portions 53B are connected to the peripheral wall portion 5 such that an inner space 51Ba of the tubular structure portion 51B communicates with the inner space of the through-hole 5*b*.

The tubular structure portions 51B and the peripheral wall portion 5 may be formed as separate components, or they may be formed integrally.

The pair of gongs 65 are formed in an arcuate configuration extending along the peripheral wall portion 5, and are respectively fixed to the outer surfaces of connection proximal portions 52Ba (oscillating portions) constituting a part of the central portion 52B of the tubular structure portion 51B. The gongs 65 are accommodated in the space 56B.

As the means for fixing the gongs 65 to the tubular structure portion 51B, welding, screw-fastening, etc. can be adopted. The gongs 65 may be formed integrally with the tubular structure portion 51B. Further, so long as they can transmit oscillation to the tubular structure portion 51B, the gongs 65 may not be fixed to the tubular structure portion 51B but may be held directly or indirectly in contact with the tubular structure portion 51B.

The inner surface of each connection proximal portion 52Ba faces the inner space 51Ba of the tubular structure portion 51B. The pair of connection proximal portions 52Ba are arranged at an interval in the length direction of the central portion 52B.

The hammers 66 are supported by the main plate (not shown) or the like of the movement 1B so as to be rotatable around rotation shafts 66*a*. Through the rotation, the hammers 66 can strike the gongs 65.

The oscillation generated in the gongs 65 through the striking of the gongs 65 by the hammers 66 is transmitted to the connection proximal portions 52Ba of the tubular structure portion 51B.

The sound generated through the oscillation of the tubular structure portion 51B is transmitted to the external space 60 via the inner space 51Ba of the tubular structure portion 51B and through the external openings 5*f*. Thus, the sound generated in the movement 1B can be transmitted to the exterior efficiently and at a high volume level.

In the timepiece 10B, the space 56B defined between the tubular structure portion 51B and the timepiece case 2 is of a hermetic structure, so that it is possible to secure a waterproof performance.

Since it has the gongs 65, the timepiece 10B can transmit loud sound to the exterior.

[Fourth Embodiment]

Figure 8:
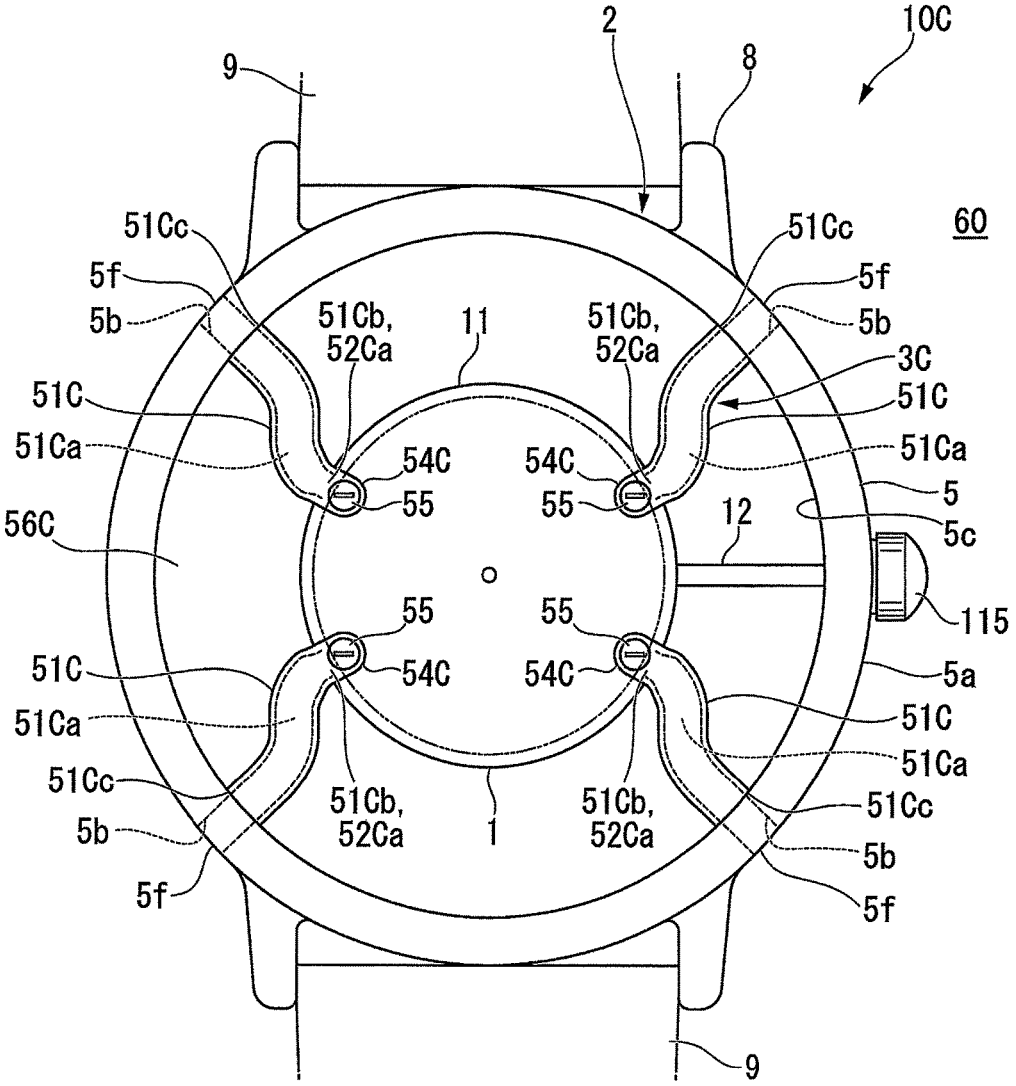
FIG. 8 is a plan view of the inner structure of a timepiece according to a fourth embodiment of the present invention.

FIG. 8 is a diagram schematically illustrating the structure of a timepiece 10C according to the fourth embodiment.

The timepiece 10C is equipped with the movement 1, the timepiece case 2, and a sound emission structure portion 3C.

The sound emission structure portion 3C has a plurality of, e.g., four, tubular structure portions 51C (hollow structure portions). At one end portion 51Cb (connection proximal portion 52Ca, the oscillating portion) of each tubular structure portion 51C, there is formed a plate-like connection portion 54C protruding inwardly in the radial direction of the peripheral wall portion 5.

Each connection portion 54C is fixed to the main plate 11 through screwing or the like by a fastening member 55. It is desirable for the connection positions of the plurality of connection portions 54C with respect to the main plate 11 to be different positions in the peripheral direction of the main plate 11.

The other end portion 51Cc of each tubular structure portion 51C is connected to the inner surface 5*c* of the peripheral wall portion 5 so that communication may be established between the inner space 51Ca of the tubular structure portion 51C and the inner space of the through-hole 5*b*. The other end portion 51Cc thereof is bonded to the inner surface 5*c* of the peripheral wall portion 5 in a liquid-tight fashion, so that the space 56C defined between the tubular structure portion 51C and the timepiece case 2 is of a hermetic structure.

The tubular structure portion 51C and the peripheral wall portion 5 may be separate components, or they may be formed integrally.

The oscillation generated in the movement 1 is transmitted to the connection proximal portion 52Ca of the tubular structure portion 51C.

The sound generated through the oscillation of the tubular structure portion 51C is transmitted to the external space 60 via the inner space 51Ca of the tubular structure portion 51C and through the external opening 5*f*. Thus, the sound (e.g., the ticking sound) generated in the movement 10 can be transmitted to the exterior efficiently and at a high volume level.

In the timepiece 10C, the space 56C defined between the tubular structure portion 51C and the timepiece case 2 is of a hermetic structure, so that it is possible to secure a waterproof performance.

In the timepiece 10C, one end portion 510*b* of the tubular structure portion 51C is connected to the movement 1, so that it is possible to shorten the tubular structure portion 51C. Thus, it is possible to achieve space saving in the space 56C inside the timepiece case 2.

[Fifth Embodiment]

Figure 9:
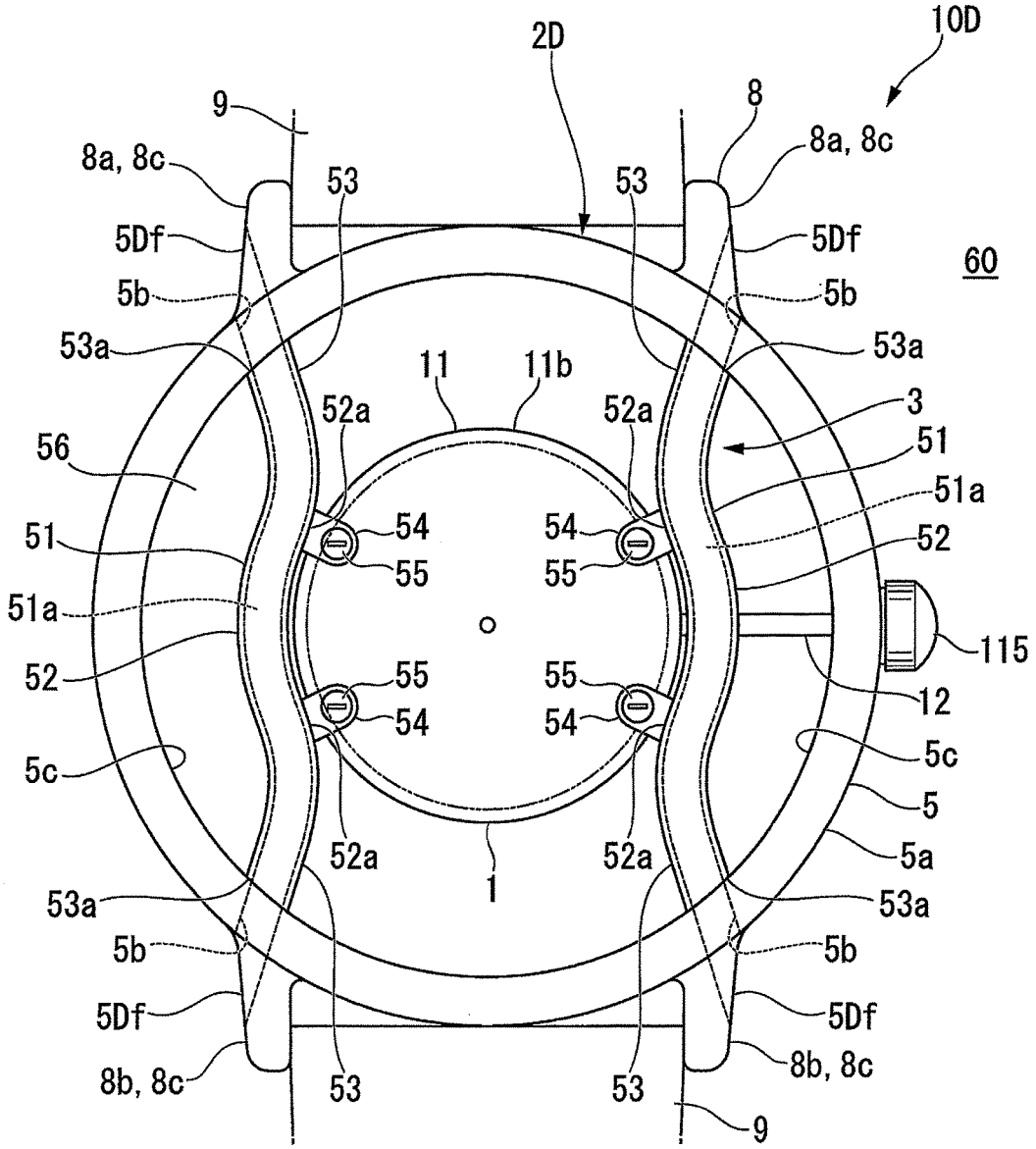
FIG. 9 is a plan view of the inner structure of a timepiece according to a fifth embodiment of the present invention.

FIG. 9 is a diagram schematically illustrating the structure of a timepiece 10D according to the fifth embodiment.

A timepiece case 2D of the timepiece 10D differs from that of the timepiece 10 shown in FIG. 1, etc. in that the through-holes 5*b* reach the lugs 8. The external openings 5Df of the through-holes 5*b* are formed partially or entirely in the outer surfaces 8*c* of the lugs 8 (more specifically, the first lugs 8*a* and the second lugs 8*b*).

In the timepiece 10D, at least a part of the external openings 5Df is formed in the lugs 8, so that there are less restrictions in terms of design at the peripheral wall portion 5, which is advantageous from the viewpoint of degree of freedom in the design of the timepiece case 2D.

[Sixth Embodiment]

Figure 10:
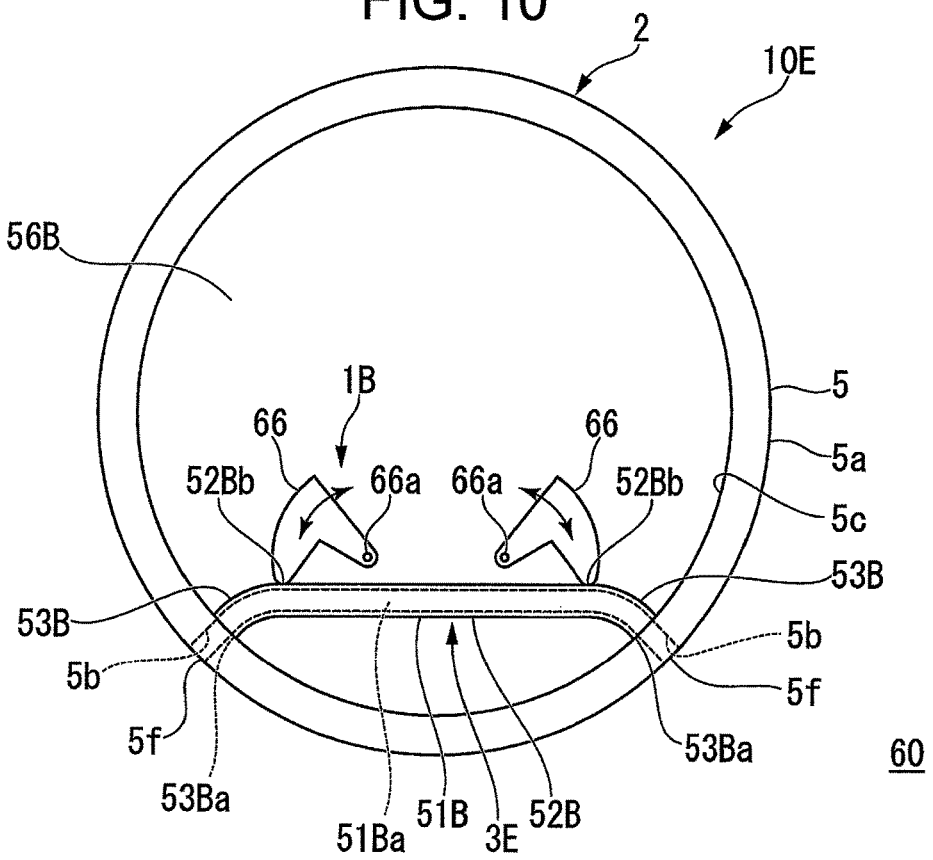
FIG. 10 is a plan view of the inner structure of a timepiece according to a sixth embodiment of the present invention.

FIG. 10 is a diagram schematically illustrating the structure of a timepiece 10E according to the sixth embodiment.

The timepiece 10E differs from the timepiece 10B shown in FIG. 7 in that the sound emission structure portion 3E is equipped with no gongs 65.

The hammers 66 rotate around the rotation shafts 66*a*, whereby they can strike the outer surfaces of struck portions 52Bb (oscillating portions) constituting apart of the central portion 52B of the tubular structure portion 51B. The inner spaces of the struck portions 52Bb face the inner space 51Ba of the tubular structure portion 51B.

The hammers 66 strike the struck portions 52Bb, whereby the tubular structure portion 51B oscillates. The sound generated through the oscillation of the tubular structure portion 51B is transmitted to the external space 60 via the inner space 51Ba and through the external openings 5*f*. Thus, the sound generated in the movement 1B can be transmitted to the exterior efficiently and at a high volume level.

In the timepiece 10E, the space 56B defined between the tubular structure portion 51B and the timepiece case 2 is of a hermetic structure, so that it is possible to secure a waterproof performance.

In the timepiece 10E, it is possible to directly strike the tubular structure portion 51B with the hammers 66 and to greatly oscillate the tubular structure portion 51B, so that it is possible to increase the volume level of the sound emitted through the external openings 5*f*.

Further, the timepiece 10E requires no gongs, so that it is possible to achieve space saving in the space 56B inside the timepiece case 2. Thus, it is possible to achieve a reduction in the size of the timepiece 10E.

The technical scope of the present invention is not restricted to that of the above embodiments but allows various modifications without departing from the scope of the gist of the present invention.

Figure 11:
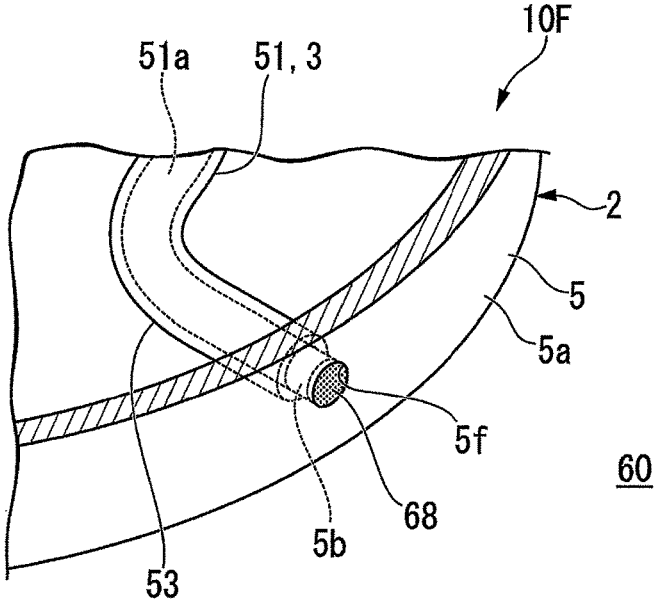
FIG. 11 is a diagram schematically illustrating a modification of the timepiece according to the first embodiment.

FIG. 11 is a diagram schematically illustrating a part of a timepiece 10F according to a modification of the timepiece 10 of the first embodiment.

The timepiece 10F differs from the timepiece 10 shown in FIG. 1, etc. in that a filter 68 closing the through-hole 5*b* is provided in the through-hole 5*b* formed in the timepiece case 2.

The material of the filter 68 selected is one which does not hinder the transmission of sound from the tubular structure portion 51 to the external space 60 and which prevents intrusion of foreign matter from the outside. There is no particular restriction regarding the material of the filter 68, and it is possible to use, for example, a resin film having a multitude of breathing holes or a metal film. The filter 68 may also be formed of fibers consisting of metal, resin or the like.

Figure 12:
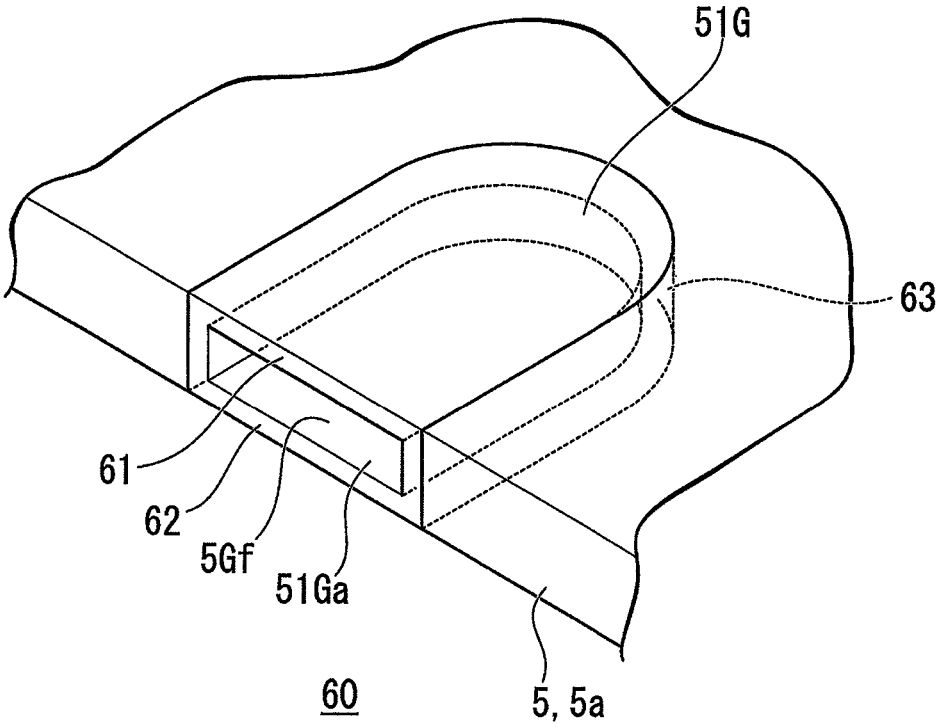
FIG. 12 is a perspective view of a modification of a hollow structure portion.

FIG. 12 is a diagram illustrating a hollow structure portion 51G which is another example of the hollow structure portion.

The hollow structure portion 51G is equipped with first and second plate-like wall portions 61 and 62 opposite each other, and a side wall portion 63 formed at a part of the peripheral edges of the first and second wall portions 61 and 62. The hollow structure portion 51G is provided inside the timepiece case 2.

The first wall portion 61 constitutes an oscillating portion connected directly or indirectly to the movement 1. The space defined between the hollow structure portion 51G and the timepiece case 2 is of a hermetic structure. An inner space 51Ga of the hollow structure portion 51G is a space defined by the first and second wall portions 61 and 62 and the side wall portion 63, and communicates with the external space 60 through an external opening 5Gf of the peripheral wall portion 5.

In this construction, the plate-like first wall portion 61 is connected to the movement 1, so that by adjusting the resonance frequency of the first wall portion 61, it is possible to transmit the oscillation of the movement 1 to the exterior more efficiently.

In the case where the sound source is a minute repeater, it is possible to adjust the tone of the minute repeater by adjusting the resonance frequency of the first wall portion 61.

[Seventh Embodiment]

Figure 13:
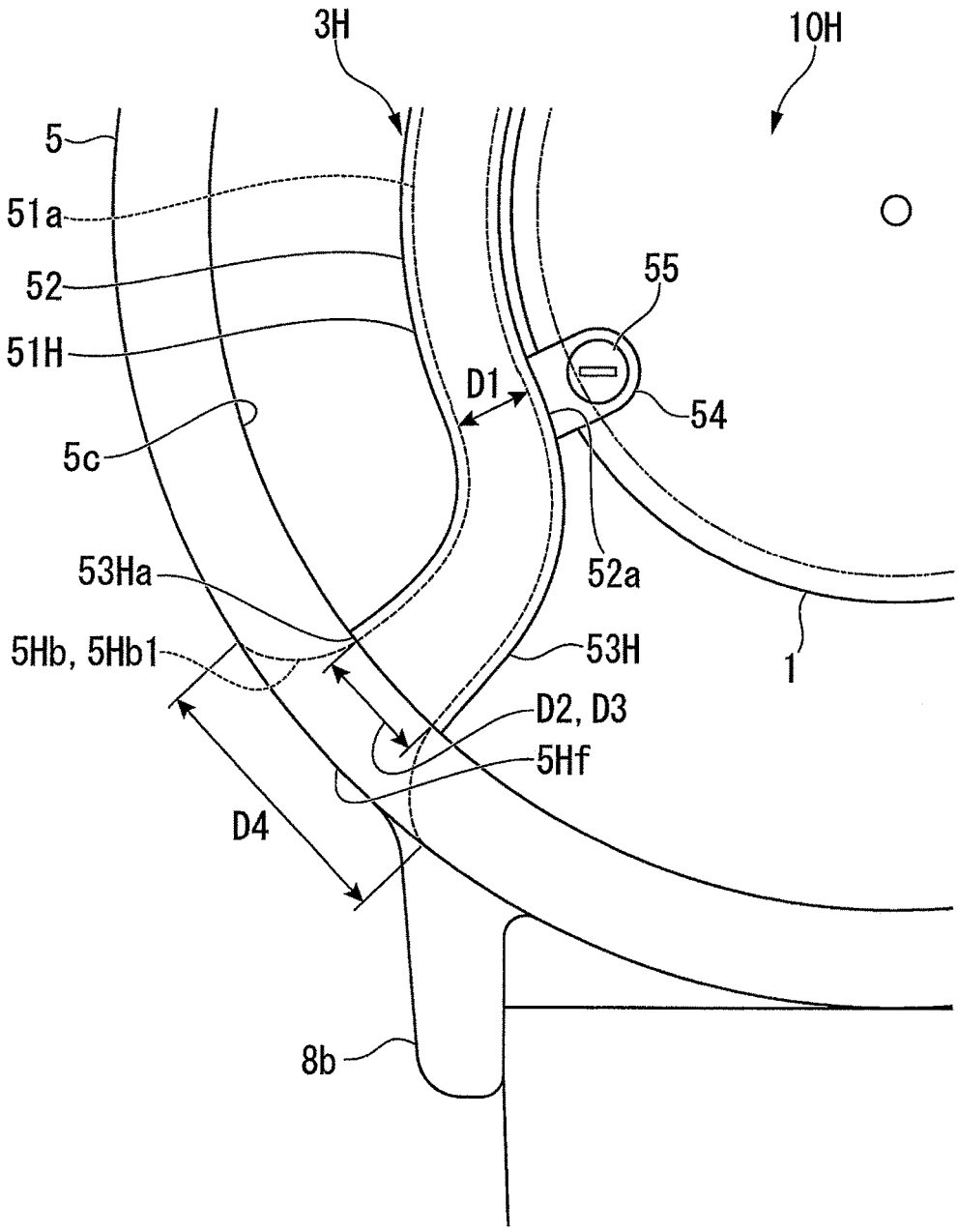
FIG. 13 is a plan view of the inner structure of a timepiece according to a seventh embodiment of the present invention.

FIG. 13 is a plan view illustrating the inner structure of a timepiece 10H according to the seventh embodiment.

In the timepiece 10H, an extension portion 53H of a tubular structure portion 51H of a sound emission structure portion 3H is formed so as to be gradually increased in inner diameter as it extends toward the peripheral wall portion 5. Further, a through-hole 5Hb formed in the peripheral wall portion 5 is formed so as to be gradually increased in inner diameter as it extends from the inner surface 5*c* of the peripheral wall portion 5 toward an external opening 5Hf. In these respects, the timepiece 10H differs from the timepiece 10 of the first embodiment shown in FIG. 2.

The inner diameter D2 of the tubular structure portion 51H at the distal end portion 53Ha of the extension portion 53H is larger than the inner diameter D1 of the tubular structure portion 51H at the connection proximal portion 52*a*.

It is desirable for the inner peripheral surface 5Hb1 of the through-hole 5Hb to be of a configuration in which the inclination angle of the through-hole 5Hb with respect to the center axis is gradually increased from the inner surface 5*c* of the peripheral wall portion 5 toward the external opening 5Hf, e.g., of a trumpet-like configuration.

The inner diameter D3 at the inner surface 5*c* of the through-hole 5Hb is equal to the inner diameter D2 of the tubular structure portion 51H at the distal end portion 53Ha.

The inner diameter D4 of the external opening 5Hf is larger than the inner diameter D3 of the through-hole 5Hb at the inner surface 5*c*. Thus, the inner diameter D4 is larger than the inner diameter D1 of the tubular structure portion 51H at the connection proximal portion 52*a*.

In the timepiece 10H, the inner diameter D4 of the external opening 5Hf is larger than the inner diameter D1 of the tubular structure portion 51H at the connection proximal portion 52*a*, so that it is possible to diminish the influence of sound diffraction, etc., making it possible to increase the volume of the sound emitted through the external opening 5Hf. Thus, the sound generated in the movement 1 (e.g., the ticking sound) can be transmitted to the exterior at a higher volume level.

While the extension portion 53H of the tubular structure portion 51H is of a configuration gradually increased in inner diameter as it extends toward the peripheral wall portion 5, it may also be of a configuration exhibiting a fixed inner diameter in the length direction.

The configuration of the inner peripheral surface 5Hb1 of the through-hole 5Hb is not restricted to a trumpet-like configuration; it may also be, for example, of a truncated-cone-shaped configuration in which the inclination angle of the through-hole 5Hb with respect to the center axis is fixed from the inner surface 5*c* of the peripheral wall portion 5 to the external opening 5Hf.

[Eighth Embodiment]

Figure 14:
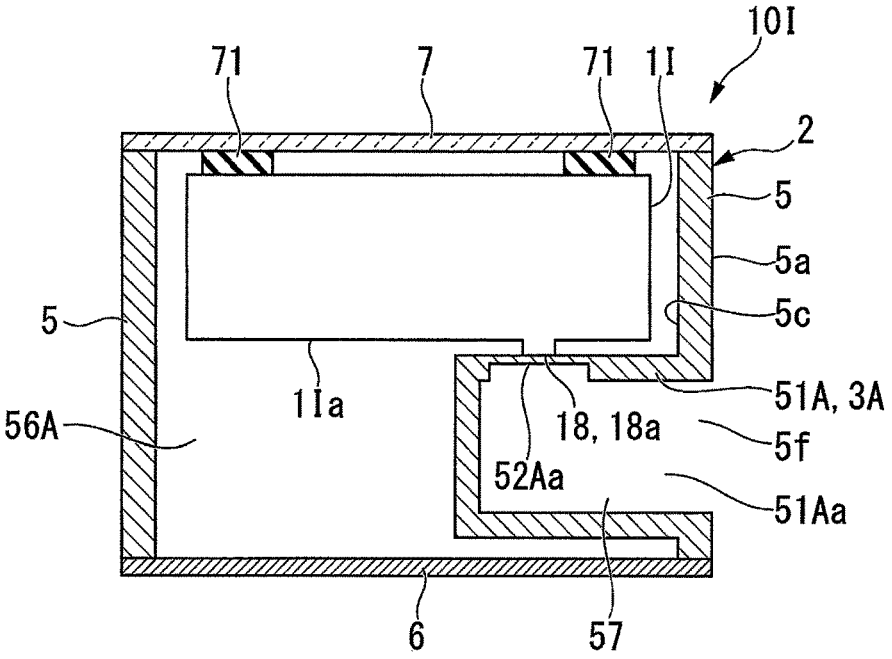
FIG. 14 is a diagram schematically illustrating the structure of a timepiece according to an eighth embodiment of the present invention.

FIG. 14 is a diagram schematically illustrating the structure of a timepiece 10I according to the eighth embodiment.

The timepiece 10I differs from the timepiece 10A shown in FIG. 6 in that an abutment protrusion 18 is formed on the surface (e.g., the lower surface 1Ia) of a movement 1I.

The abutment protrusion 18 is, for example, of a rectangular sectional configuration (e.g., a columnar configuration in which the center axis direction coincides with the protruding direction of the abutment protrusion 18), and is formed so as to protrude downwards from the lower surface of the movement 1I (toward the connection proximal portion 52Aa).

In the movement 1I, the protrusion end surface 18*a* of the abutment protrusion 18 abuts solely a part of the connection proximal portion 52Aa (thin-walled portion), e.g., the central portion of the connection proximal portion 52Aa.

The movement 1I is supported on the inner surface of the timepiece case 2 by one or a plurality of elastic support portions 71. The elastic support portion 71 is formed of an elastic material such as rubber, silicone type resin, and acrylate type resin, and is capable of elastic deformation. The elastic support portion 71 is provided between the outer surface of the movement 1I and the inner surface of the timepiece case 2, whereby it is possible to set the movement 1I in position with respect to the timepiece case 2.

In the timepiece 10I, the abutment protrusion 18 of the movement 1I abuts solely a part of the connection proximal portion 52Aa, so that the connection proximal portion 52Aa is subject to oscillation. Thus, the sound generated in the movement 1I (e.g., the ticking sound) can be transmitted to the exterior via the tubular structure portion 51A at a high volume level.

In the timepiece 10I, the movement 1I is supported by the elastic support portion 71, so that oscillation is not easily transmitted to the timepiece case 2; thus, it is possible to preferentially transmit the oscillation of the movement 1I to the connection proximal portion 52Aa. Thus, it is possible to transmit the sound of the movement 1I to the exterior at a higher volume level.

While in the timepiece 10I shown in FIG. 14 the movement 1I and the connection proximal portion 52Aa abut each other at the abutment protrusion 18 formed on the movement 1I, the abutment protrusion may also be formed on the connection proximal portion. That is, the movement and the connection proximal portion may abut each other at the abutment protrusion formed on the connection proximal portion, thereby causing the movement to abut solely a part of the connection proximal portion. Further, abutment protrusions may be formed on both of the movement and the connection proximal portion, causing these abutment protrusions to abut each other.

[Ninth Embodiment]

Figure 15:
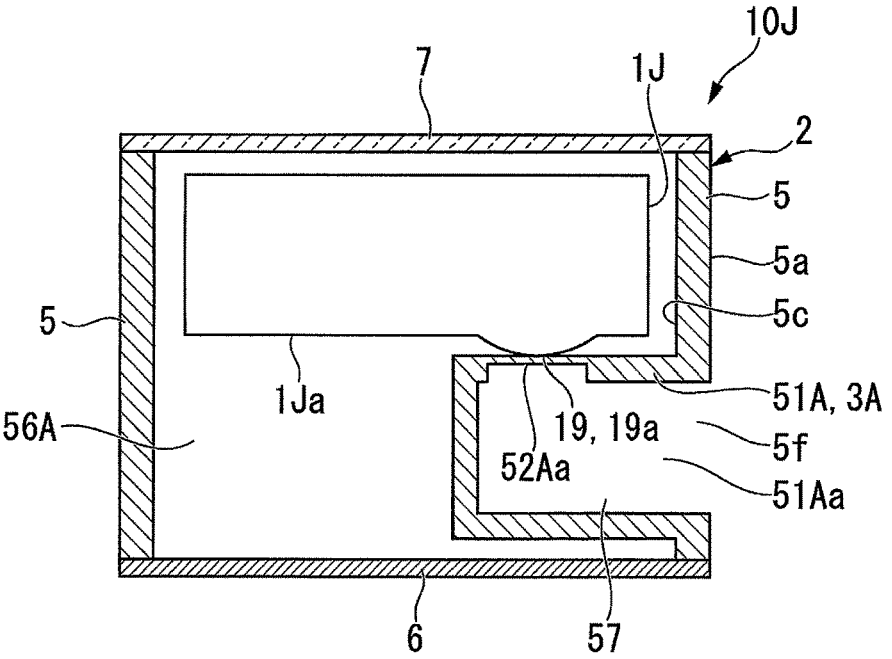
FIG. 15 is a diagram schematically illustrating the structure of a timepiece according to a ninth embodiment of the present invention.

FIG. 15 is a diagram schematically illustrating the structure of a timepiece 10J according to the ninth embodiment.

In the timepiece 10J, an abutment protrusion 19 is formed on a surface (e.g., the lower surface 1Ja) of a movement 1J.

The timepiece 10J differs from the timepiece 10I shown in FIG. 14 in that the abutment protrusion 19 is of a curved protrusion configuration. The abutment protrusion 19 is, for example, of a spherical or an elliptical outer surface configuration. The apex portion 19*a*, for example, of the abutment protrusion 19 abuts solely a part of the connection proximal portion 52Aa, for example, solely the central portion of the connection proximal portion 52Aa.

In the timepiece 10J, the apex portion 19*a* of the abutment protrusion 19 is in point contact with the connection proximal portion 52Aa, so that the contact area between the abutment protrusion 19 and the connection proximal portion 52Aa is small. Thus, it is easier for the connection proximal portion 52Aa to oscillate. Thus, the sound generated in the movement (e.g., the ticking sound) can be transmitted to the exterior via the tubular structure portion 51A at a high volume level.

[Tenth Embodiment]

Figure 16:
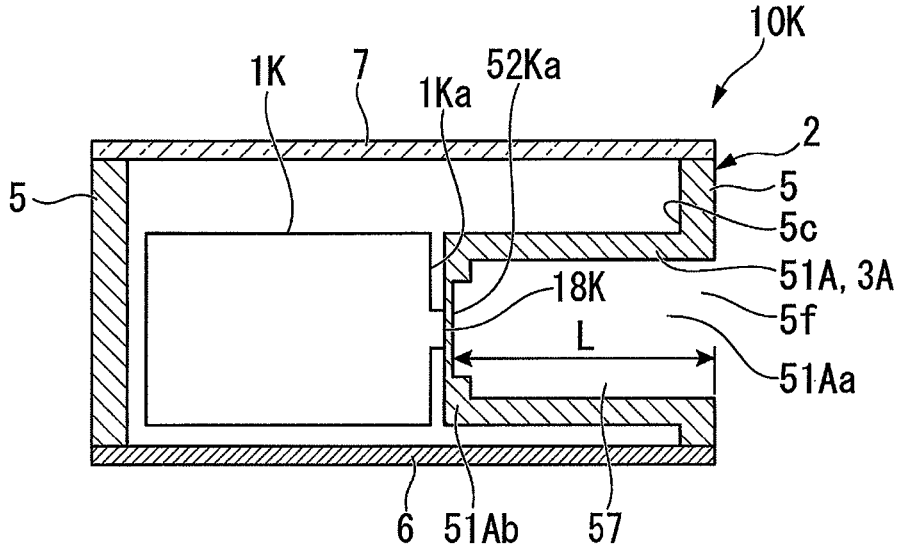
FIG. 16 is a diagram schematically illustrating the structure of a timepiece according to a tenth embodiment of the present invention.

FIG. 16 is a diagram schematically illustrating the structure of a timepiece 10K according to the tenth embodiment.

The tubular structure portion 51A of the timepiece 10K is of a closed pipe structure having an external opening 5*f* solely at one end portion thereof. In the timepiece 10K, a connection proximal end portion 52Ka (thin-walled portion) is formed at a deeper-most end wall 51Ab (deeper-most end). The inner diameter of the tubular structure portion 51A may be fixed in the length direction.

An abutment protrusion 18K is formed on a surface (e.g., a side surface 1Ka) of the movement 1K. The abutment protrusion 18K abuts solely a part of the connection proximal portion 52Ka, for example, solely the central portion of the connection proximal portion 52Ka.

It is desirable for the length L of the tubular structure portion 51A as measured from the deeper-most end wall 51Ab to the external opening 5*f* (the length from the connection proximal portion 52Ka to the external opening 5*f*) to be expressed by formula (1). The length L is the length of the tubular structure portion 51A.

$$\lambda_n(2n-1)/4 \quad (1)$$

(where $\lambda_n$ is the wavelength of the sound emitted from the movement; and n is a natural number.)

The length L may coincide with $\lambda_n(2n-1)/4$; however, even when it does not coincide with $\lambda_n(2n-1)/4$, the length L can be regarded as "a value to be expressed by the formula $\lambda_n(2n-1)/4$" so long as it is within a range of ±10% with respect to the value of $\lambda_n(2n-1)/4$.

In the timepiece 10K, the length L of the tubular structure portion 51A is expressed by formula (1), so that it is possible to cause resonance in the tubular structure portion 51A, making it possible to transmit the sound of the movement 1K to the exterior at a higher volume level.

Here, it is known that the frequency of the sound generated by the movement ranges from 3600 Hz to 19000 Hz. Above all, the dominant frequency range is 13000 Hz to 19000 Hz.

For example, when the ambient temperature is 23° C., the sound velocity is approximately 346 m/s; when the frequency ranges from 3600 Hz to 19000 Hz, the wavelength of the sound wave corresponding to the above frequency is approximately 18 mm to 96 mm. Likewise, when the frequency ranges from 13000 Hz to 19000 Hz, the wavelength of the sound wave corresponding to the above frequency is approximately 18 mm to 27 mm.

Suppose the above wavelength value of 18 mm to 96 mm is applied to the case where the frequency ranges from 13000 Hz to 19000 Hz, when n=1, L is 4.5 mm to 24 mm. Suppose the above wavelength value of 18 mm to 27 mm is applied to the case where the frequency ranges from 3600 Hz to 19000 Hz, when n=1, L is 4.5 mm to 6.75 mm.

While the timepiece 10K has only one tubular structure portion 51A with respect to one connection proximal portion 52Ka, the above timepiece may have a plurality of tubular structure portions (hollow structure portions) with respect to one oscillating portion. In this case, it is possible to transmit the sound generated by the oscillation of the one oscillating portion to the exterior via the plurality of tubular structure portions.

When, as in the case of the timepiece 10 shown in FIG. 2, the tubular structure portion 51 is of an open pipe structure having external openings 5*f* at both ends thereof, it is desirable for the length of the tubular structure portion 51 (the length as measured from one external opening 5*f* to the other external opening 5*f*) to be expressed by formula (2).

$$\lambda_n \cdot n/4 \quad (2)$$

(where $\lambda_n$ is the wavelength of the sound emitted from the movement; and n is a natural number.)

It is desirable for the above length to coincide with $\lambda_n \cdot n/4$; however, even when it does not coincide with $\lambda_n \cdot n/4$, the length can be regarded as "a value to be expressed by the formula: $\lambda_n \cdot n/4$" so long as it is within the range, for example, of ±10% with respect to $\lambda_n \cdot n/4$.

Also in the case where the length L of the tubular structure portion 51 is expressed by formula (2), it is possible to cause resonance in the tubular structure portion 51, so that it is possible to transmit the sound of the movement to the exterior at a higher volume level.

The sound source of the movement may also be a click or a clutch wheel. The click or the clutch wheel may be supported, for example, by the main plate. The click or the clutch wheel generates oscillation when rotating the winding stem. Also the sound generated by the click or the clutch wheel can be transmitted efficiently to the exterior by the hollow structure portion via the main plate, etc.

The sound source of the movement may also be a stop wheel provided in a remontoire mechanism (constant-force mechanism; constant-torque mechanism). Generally speaking, the remontoire mechanism has a stop wheel, a stopper, and a constant-force spring, and with respect to the stop wheel driven by the torque of a barrel drum, the stopper repeats the engagement and releasing at a fixed cycle, whereby the constant-force spring connected to the stop wheel is wound up. Further, by the torque generated by the constant-force spring, the train wheel including a governor, and the stopper are driven. When the stop wheel and the stopper are engaged with each other, oscillation is generated, and the sound generated by this oscillation can be transmitted to the exterior efficiently by the hollow structure portion.

The sound source may be an alarm device, a minute repeater, a speaker or the like. The alarm device, the minute repeater, the speaker or the like constitutes a part of the movement.

The timepiece of the present invention can also adopt a construction in which a part of the hollow structure portion protrudes from the outer surface of the timepiece case.

In the timepiece 10 of FIG. 1, the sound emission structure 3 has two tubular structure portions 51 (hollow structure portions); there are, however, no particular restrictions regarding the number of hollow structure portions constituting the sound emission structure portion; the number of hollow structure portions may be one or an arbitrary number of two or more.

While in the timepiece 10 of FIG. 1 the tubular structure portion 51 is connected to the peripheral wall portion 5 and communicates with the external space 60 via the external opening 5*f* of the peripheral wall portion 5, the hollow structure portion may be connected to the case back portion and communicate with the external space via the external opening of the case back portion.

What is claimed is:

1. A timepiece comprising: a movement; a case accommodating the movement; and a hollow tubular structure portion having an oscillating portion directly or indirectly in contact with the movement, wherein the hollow tubular structure portion is configured such that a space defined between itself and the case is hermetically sealed; and wherein the inner space of the hollow tubular structure portion communicates with the exterior of the case via an external opening of the case.

2. The timepiece according to claim 1, wherein the oscillating portion constitutes a part of the hollow tubular structure portion and faces the inner space.

3. The timepiece according to claim 1, wherein the oscillating portion is directly or indirectly in contact with a main plate of the movement.

4. The timepiece according to claim 1, further comprising a gong connected to the oscillating portion, wherein the movement has a hammer positioned to strike the gong.

5. The timepiece according to claim 1, wherein the movement has a hammer positioned to strike the hollow tubular structure portion.

6. The timepiece according to claim 1, wherein the hollow tubular structure portion does not protrude with respect to the external surface of the case.

7. The timepiece according to claim 1, wherein the hollow tubular structure portion has two end portions and extends in a predetermined direction; and the inner space communicates with the exterior of the case through external openings of the case at the two end portions of the hollow tubular structure portion.

8. The timepiece according to claim 1, wherein the external opening and the hollow tubular structure portion have generally circular cross sections; and the inner diameter of the external opening is larger than the inner diameter of the hollow tubular structure portion at the oscillating portion.

9. The timepiece according to claim 1, wherein an abutment protrusion is formed on at least one of the movement and the oscillating portion; and the movement and the oscillating portion abut each other at the abutment protrusion, whereby the movement is held in contact with solely a part of the oscillating portion.

10. The timepiece according to claim 9, wherein the abutment protrusion is formed as a curved protrusion.

11. The timepiece according to claim 1, wherein at least a part of the oscillating portion has a thin-walled portion which is thinner than the other portion of the hollow tubular structure portion; and the thin-walled portion is in contact with the movement.

12. The timepiece according to claim 1, wherein the movement abuts the case via an elastic support portion having elasticity.

13. The timepiece according to claim 1, wherein the hollow tubular structure portion is of a closed-pipe structure having the external opening solely at one end portion thereof, and the length as measured from the oscillating portion to the external opening can be expressed by formula (1)

$$\lambda_n(2n-1)/4 \quad (1)$$

(where $\lambda_n$ is the wavelength of the sound emitted from the movement; and n is a natural number).

14. The timepiece according to claim 1, wherein the hollow tubular structure portion is of an open-pipe structure having the external openings at both end portions thereof, the length thereof being expressed by formula (2)

$$\lambda_n \cdot n/4 \quad (2)$$

(where $\lambda_n$ is the wavelength of the sound emitted from the movement; and n is a natural number).

15. The timepiece according to claim 1, wherein the movement has a remontoire mechanism.

16. A timepiece comprising:

a case;

a mechanical movement disposed in the case and configured to oscillate and generate sound during timekeeping; and a hollow tubular structure disposed in the case and having an oscillation portion directly or indirectly contacting the movement so that oscillation of the movement is transmitted to the oscillation portion, wherein the hollow tubular structure and the case jointly define a hermetically sealed space inside the case, and the inner space of the hollow tubular structure communicates with the exterior of the case through an external opening in the case to transmit sound generated through oscillation of the movement to the exterior.

17. The timepiece according to claim 16; further comprising a second hollow tubular structure disposed in the case and having an oscillation portion directly or indirectly contacting the movement, the inner space of the second hollow tubular structure communicating with the exterior of the case through a second external opening in the case.

18. the timepiece according to claim 16; wherein the hollow tubular structure has opposite end portions each communicating the inner space of the hollow tubular structure with the exterior of the case through external openings in the case.

19. The timepiece according to claim 18; wherein the end portions of the hollow tubular structure do not protrude from the external surface of the case.

20. The timepiece according to claim 16; wherein the hollow tubular structure does not protrude from the external surface of the case.

* * * * *